US010714875B2

(12) United States Patent
Wan et al.

(10) Patent No.: US 10,714,875 B2
(45) Date of Patent: Jul. 14, 2020

(54) ELECTRICAL RECEPTACLE CONNECTOR

(71) Applicant: ADVANCED-CONNECTEK INC., New Taipei (TW)

(72) Inventors: Wei Wan, New Taipei (TW); Xiao-Juan Qi, New Taipei (TW); Hua-Yan Wu, New Taipei (TW); Zhen-Xing Zheng, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/031,258

(22) Filed: Jul. 10, 2018

(65) Prior Publication Data

US 2019/0020154 A1 Jan. 17, 2019

(30) Foreign Application Priority Data

Jul. 11, 2017 (CN) ..... 2017 1 0566382

(51) Int. Cl.

| | |
|---|---|
| ***H01R 12/72*** | (2011.01) |
| ***H01R 107/00*** | (2006.01) |
| ***H01R 24/60*** | (2011.01) |
| ***H01R 12/71*** | (2011.01) |
| ***H01R 13/6582*** | (2011.01) |

(52) U.S. Cl.

CPC ..... *H01R 13/6582* (2013.01); *H01R 12/724* (2013.01); *H01R 12/716* (2013.01); *H01R 24/60* (2013.01); *H01R 2107/00* (2013.01)

(58) Field of Classification Search

CPC ..... H01R 2107/00; H01R 24/60; H01R 13/6585; H01R 13/6581; H01R 13/6594; H01R 12/724; H01R 12/716; H01R 13/516; H01R 13/6596

See application file for complete search history.

(56) References Cited

U.S. PATENT DOCUMENTS

| | | | | |
|---|---|---|---|---|
| 5,928,035 A * | 7/1999 | Jankowsky | ..... | H01R 12/707 439/607.36 |
| 6,986,681 B2 * | 1/2006 | Tsai | ..... | H01R 12/716 439/607.36 |
| 7,270,570 B1 * | 9/2007 | Hamner | ..... | H01R 12/7052 439/607.04 |
| 7,351,105 B2 * | 4/2008 | Delaney | ..... | H01R 12/714 439/607.36 |
| 7,473,136 B2 * | 1/2009 | Hu | ..... | H01R 12/716 439/541.5 |

(Continued)

*Primary Examiner* — Edwin A. Leon
*Assistant Examiner* — Matthew T Dzierzynski
(74) *Attorney, Agent, or Firm* — Muncy, Geissler, Olds & Lowe, P.C.

(57) ABSTRACT

An electrical receptacle connector includes an insulated housing in a metallic shell. First and second receptacle terminals are on the insulated housing. The receptacle terminals include first and second high-speed signal terminals. The metallic shell includes a receptacle cavity for receiving the insulated housing, an insertion opening being in communication with the receptacle cavity, pins at two sides of the metallic shell and outwardly extending, and an external protruding structure on a bottom surface for connecting to a circuit board. The external protruding structure forms an enclosed structure. Therefore, the seamless configuration improves the reduction to electromagnetic interference.

15 Claims, 10 Drawing Sheets

(56) References Cited

U.S. PATENT DOCUMENTS

| | | | | |
|---|---|---|---|---|
| 8,388,380 | B1 * | 3/2013 | Van der Steen | H01R 13/5202 439/607.36 |
| 8,454,388 | B2 * | 6/2013 | Song | H01R 12/707 439/607.36 |
| 8,460,034 | B2 * | 6/2013 | Song | H01R 13/6594 439/607.36 |
| 8,696,384 | B2 * | 4/2014 | Yokoyama | H01R 12/77 439/607.36 |
| 8,974,249 | B2 * | 3/2015 | Zhang | H01R 12/724 439/607.4 |
| 9,190,779 | B2 * | 11/2015 | Zheng | H01R 12/724 |
| 9,231,356 | B1 * | 1/2016 | Ju | H01R 24/78 |
| 9,350,121 | B2 * | 5/2016 | Ju | H01R 13/6585 |
| 9,379,494 | B1 * | 6/2016 | Hu | H01R 13/6594 |
| 9,425,559 | B2 * | 8/2016 | Kao | H01R 13/6585 |
| 9,431,734 | B2 * | 8/2016 | Guo | H01R 12/722 |
| 9,478,915 | B2 * | 10/2016 | Guo | H01R 13/6585 |
| 9,490,595 | B2 * | 11/2016 | Little | H01R 13/6594 |
| 9,502,821 | B2 * | 11/2016 | Little | H01R 13/6582 |
| 9,577,387 | B2 * | 2/2017 | Hu | H01R 13/6597 |
| 9,640,923 | B2 * | 5/2017 | Kao | H01R 12/724 |
| 9,722,365 | B1 * | 8/2017 | Wang | H01R 13/6581 |
| 9,812,827 | B2 * | 11/2017 | Guo | H01R 12/75 |
| 9,882,316 | B2 * | 1/2018 | Chen | H01R 13/405 |
| 10,263,372 | B2 * | 4/2019 | Yao | H01R 13/6595 |
| 2014/0024260 | A1 * | 1/2014 | Dong | H01R 13/648 439/626 |

* cited by examiner

| | | | | | | | | | | | | |
|---|---|---|---|---|---|---|---|---|---|---|---|---|
| GND | TX1+ | TX1− | VBUS | CC1 | D+ | D− | SBU1 | VBUS | RX2− | RX2+ | GND | 21 |
| GND | RX1+ | RX1− | VBUS | SBU2 | D− | D+ | CC2 | VBUS | TX2− | TX2+ | GND | 22 |

Fig. 10

ELECTRICAL RECEPTACLE CONNECTOR

CROSS-REFERENCE TO RELATED APPLICATION

This non-provisional application claims priority under 35 U.S.C. § 119(a) to Patent Application No. 201710566382.8 filed in China, P.R.C. on Jul. 11, 2017, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) or High Definition Multimedia Interface (HDMI) is serial bus standard to the PC architecture with a focus on computer interface, consumer and productivity applications. The existing Universal Serial Bus (USB) interconnects or High Definition Multimedia Interface (HDMI) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a high-speed electrical connector known to the inventor(s) are totally different from those of an electrical connector known to the inventor(s). For instance, a HDMI electrical receptacle connector known to the inventor(s) includes an inner metal shell and an outer metal shell; elastic pieces are formed on the inner metal shell for contacting the plug connector, and pins are extending from two sides of the outer metal shell for soldering with a circuit board. Hence, since the inner metal shell is enclosed by the outer metal shell, the shell of the HDMI connector can have a "non-crack configuration"; alternatively, a plastic shell may be provided for enclosing the inner metal shell to have the "non-crack configuration".

SUMMARY OF THE INVENTION

However, the plug-and-insert design of the receptacle connector known to the inventor(s) is achieved by configuring elastic pieces at the cracks of the inner metal shell, so that the required plug and insert force can be achieved by the mating between the elastic pieces and the structure of the plug connector. Further, these elastic pieces are assembled on the insertion opening of the inner metal shell for improving the reduction of the electromagnetic interference (EMI). Consequently, the receptacle connector known to the inventor(s) has many components, thereby requiring a complicated manufacturing process and a higher cost.

In view of this, an embodiment of the instant disclosure provides an electrical receptacle connector. The electrical receptacle connector comprises an insulated housing, a plurality of first receptacle terminals, a plurality of second receptacle terminals, and a metallic shell. The insulated housing comprises a base portion and a tongue portion extending from one of two ends of the base portion. The tongue portion has a first surface and a second surface. Each of the first receptacle terminals is held in the base portion and the tongue portion and disposed at the first surface. The first receptacle terminals comprises a plurality of first signal terminals, and the first signal terminals comprise a plurality of first high-speed signal terminals. Each of the second receptacle terminals is held in the base portion and the tongue portion and disposed at the second surface. The second receptacle terminals comprise a plurality of second signal terminals, and the second signal terminals comprise a plurality of second high-speed signal terminals. The metallic shell comprises a receptacle cavity for receiving the insulated housing, an insertion opening being in communication with the receptacle cavity, a plurality of pins at two sides of the metallic shell and extending outwardly, and an external protruding structure. The external protruding structure is on a bottom surface of the metallic shell and between the pins. The external protruding structure comprises a contact end extending outwardly from the metallic shell. An enclosed structure is formed at the external protruding structure of the metallic shell.

In some embodiments, the metallic shell comprises a plurality of external protruding structures on the bottom surface of the metallic shell.

In some embodiments, the external protruding structure comprises a cone-shaped extending portion outwardly extending from the bottom surface of the metallic shell, and the contact end is formed at an end portion of the cone-shaped extending portion.

In some embodiments, the metallic shell comprises a plurality of internal protruding structures. The internal protruding structures are respectively formed on a top surface and the bottom surface of the metallic shell. The internal protruding structures are extending toward the receptacle cavity. An enclosed structure is formed at each of the internal protruding structures of the metallic shell.

In some embodiments, an upper portion and a lower portion of the insertion opening are symmetrical or unsymmetrical with each other.

In some embodiments, the pins comprise turning portions respectively extending from two side portions of the insertion opening.

In some embodiments, the electrical receptacle connector further comprises a circuit board. The circuit board comprises a plurality of contact points contacting the contact end and a plurality of holes for being inserted by the pins.

In some embodiments, a protruding block is outwardly protruding from an outer surface of each of the pins for being received in the corresponding hole.

In some embodiments, a rear portion of the metallic shell further comprises a rear cover covering a rear portion of the base portion.

In some embodiments, a rear portion of the metallic shell further comprises a buckling piece. A buckling groove is on a rear portion of the base portion for buckling with the buckling piece.

In some embodiments, the metallic shell further comprises a plurality of engaging grooves on the pins. A plurality of engaging blocks is on two sides of the base portion for engaging with the engaging grooves.

In some embodiments, the metallic shell comprises a bent member extending outwardly from a top portion of the insertion opening. The bent member comprises a plurality of contact arms.

As above, according to some embodiments of the instant disclosure, both the pins provided on the metallic shell as well as the external protruding structure allow the metallic shell to have a non-crack configuration (seamless configuration). Therefore, the non-crack configuration of the metallic shell improves the reduction to the electromagnetic interference. Further, the internal protruding structure is also devoid of any crack. Hence, the metallic shell provides proper reductions to the electromagnetic interference (EMI) as well as Radio frequency interference (RFI). Furthermore, the seamless configuration of the metallic shell allows the metallic shell to have a beautiful appearance. In addition, the seamless configuration of the metallic shell also improves the structural strength of the metallic shell.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 10 illustrates a schematic configuration diagram of the receptacle terminals of the electrical receptacle connector of the second embodiment.

DETAILED DESCRIPTION

Figure 1:
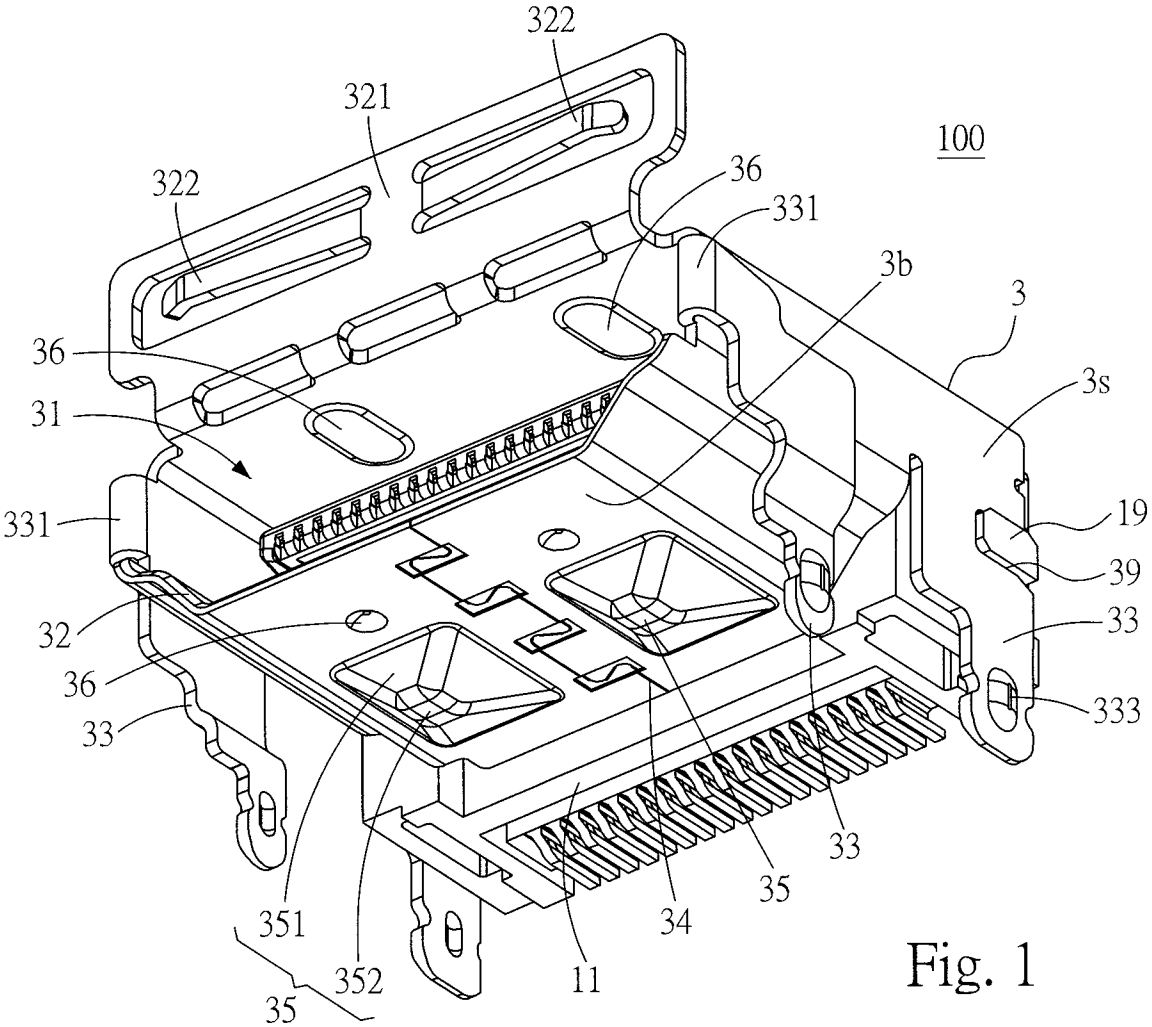
FIG. 1 illustrates a front perspective view of an electrical receptacle connector of a first embodiment of the instant disclosure.
Figure 2:
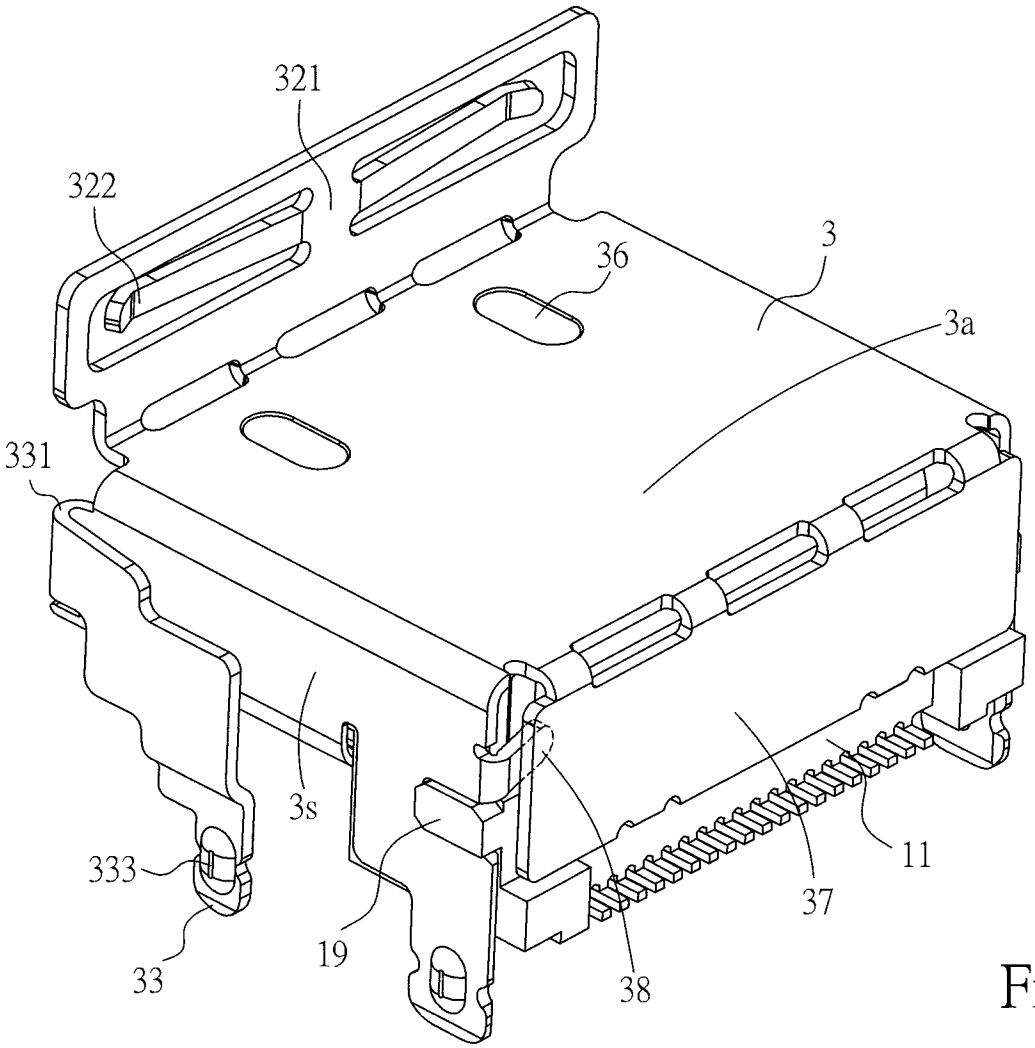
FIG. 2 illustrates a rear perspective view of the electrical receptacle connector of the first embodiment.
Figure 3:
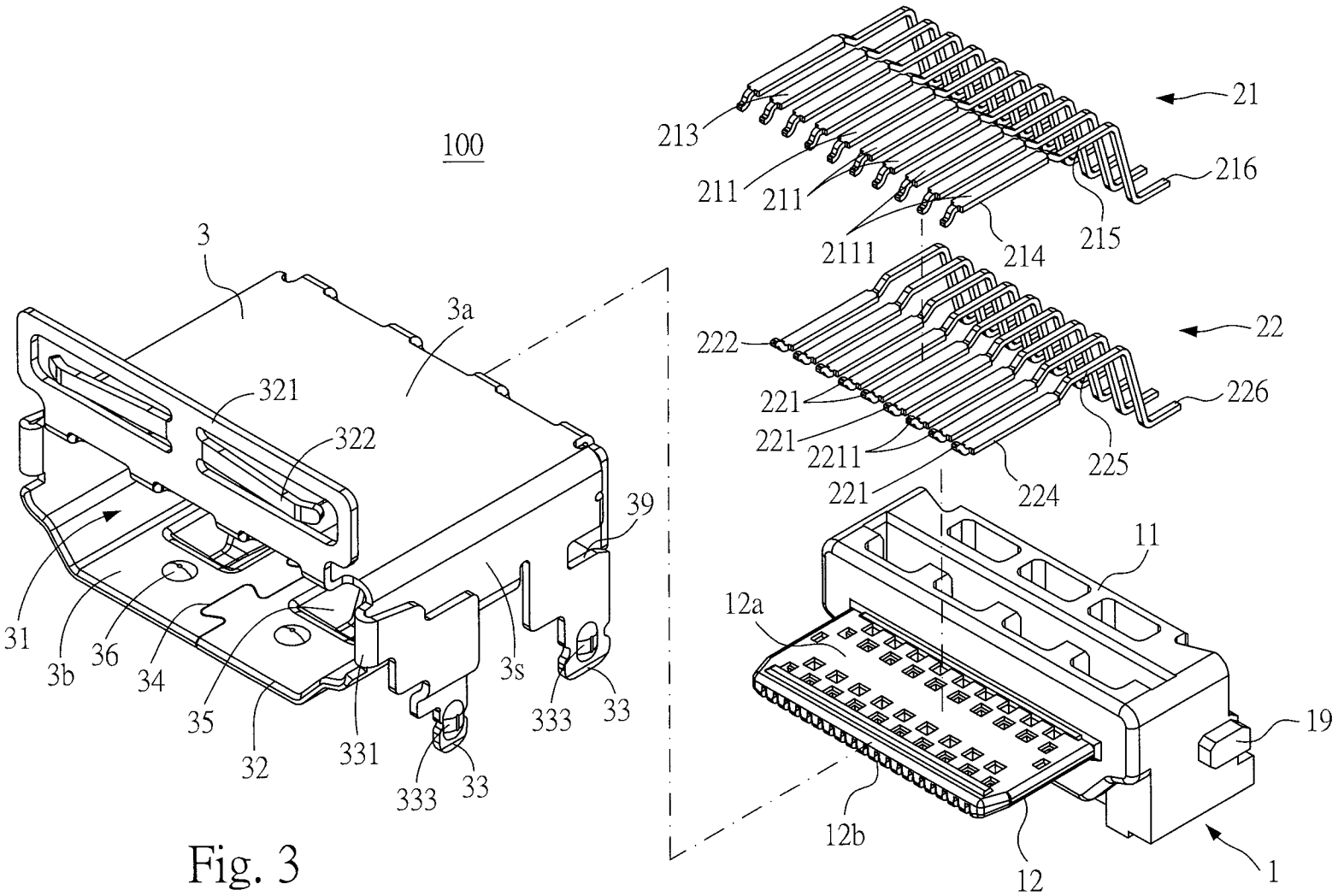
FIG. 3 illustrates an exploded view (1) of the electrical receptacle connector of the first embodiment.
Figure 8:
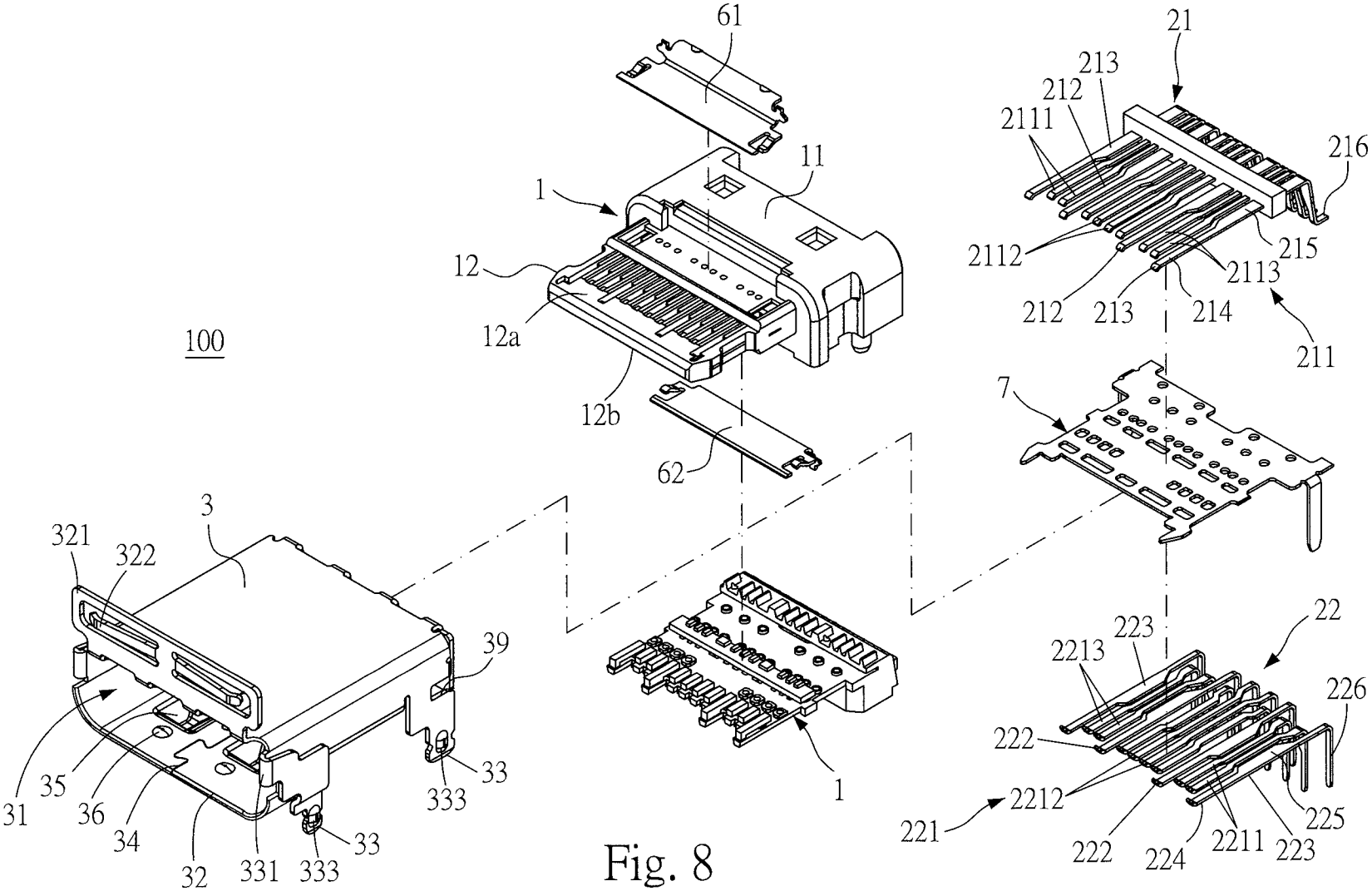
FIG. 8 illustrates an exploded view (1) of an electrical receptacle connector of a second embodiment of the instant disclosure.

Please refer to FIGS. 1 and 3, illustrating an electrical receptacle connector 100 of a first embodiment of the instant disclosure. FIG. 1 illustrates a front perspective view of the electrical receptacle connector 100 of the first embodiment of the instant disclosure. FIG. 2 illustrates a rear perspective view of the electrical receptacle connector 100 of the first embodiment. FIG. 3 illustrates an exploded view (1) of the electrical receptacle connector 100 of the first embodiment. In this embodiment, the electrical receptacle connector 100 is in accordance with the specification of an HDMI connection interface or the specification of a USB type-C connection interface (as shown in FIG. 8). In this embodiment, the electrical receptacle connector 100 comprises an insulated housing 1, a plurality of first receptacle terminals 21, a plurality of second receptacle terminals 22, and a metallic shell 3.

Please refer to FIGS. 1 to 3, in the first embodiment, the insulated housing 1 is an elongated member and comprises a base portion 11 and a tongue portion 12. In this embodiment, the first receptacle terminals 21, the second receptacle terminals 22, and the insulated housing 1 are assembled with each other by insert-molding techniques. The tongue portion 12 is extending from one of two ends of the base portion 11. The tongue portion 12 has two opposite surfaces, one is a first surface 12*a*, and the other is the second surface 12*b*. In addition, a front lateral surface of the tongue portion 12 is connected the first surface 12*a* with the second surface 12*b* and is close to the insertion opening 32 of the metallic shell 3. In other words, the front lateral surface is near the insertion opening 32 and perpendicularly connected to the first surface 12*a* and the second surface 12*b*, respectively.

Figure 4:
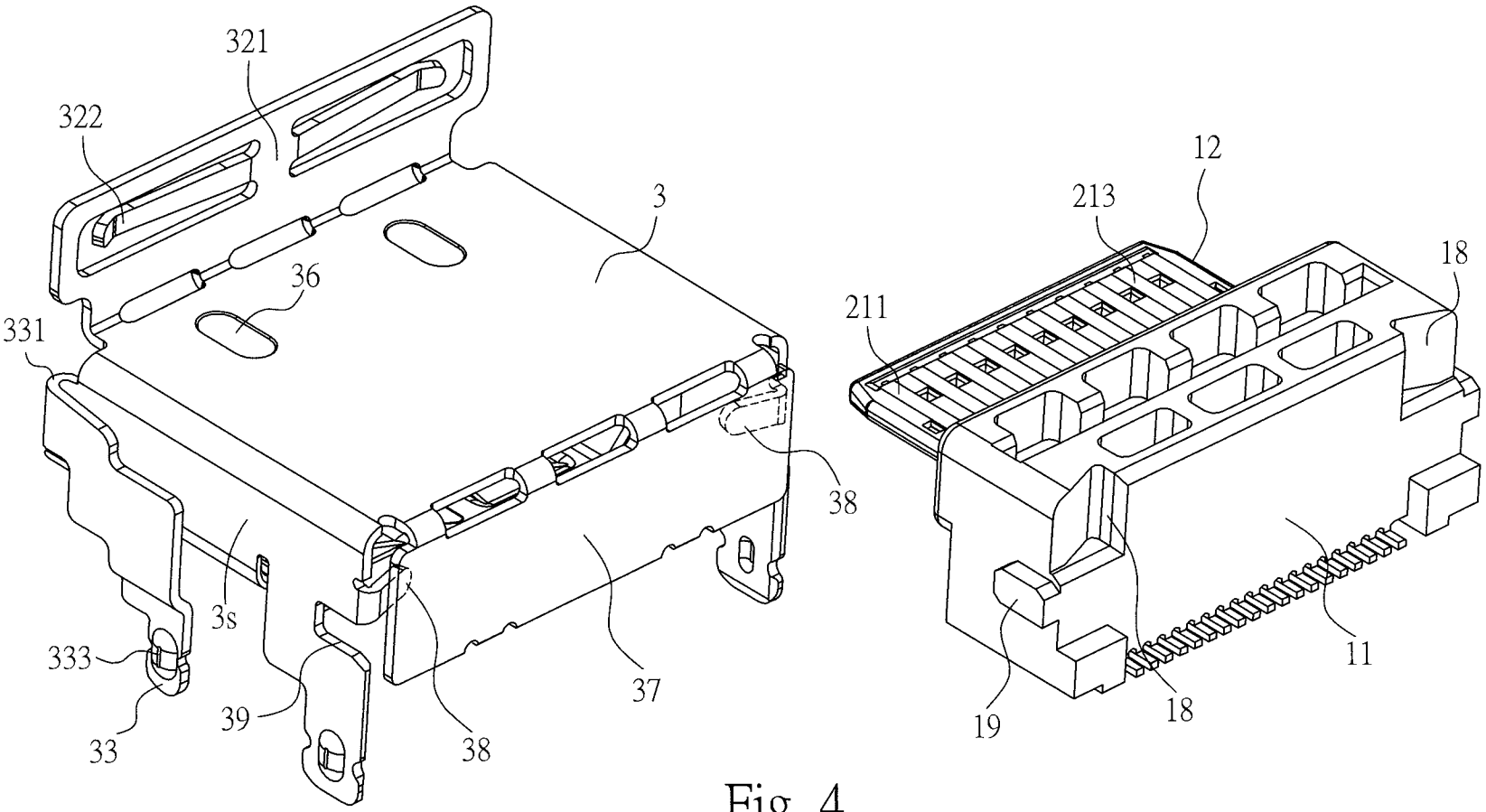
FIG. 4 illustrates an exploded view (2) of the electrical receptacle connector of the first embodiment.

Please refer to FIGS. 1 to 4. FIG. 4 illustrates an exploded view (2) of the electrical receptacle connector of the first embodiment. In the first embodiment, the first receptacle terminals 21 are at the base portion 11 and the tongue portion 12. In this embodiment, the first receptacle terminals 21 comprise a plurality of first signal terminal 211 and at least one ground terminal 213, and the first receptacle terminals 21 are held in the base portion 11 and the tongue portion 12 and disposed at the first surface 12*a*. From a front view of the first receptacle terminals 21, the first receptacle terminals 21 comprise, from the right to left, a first pair of first signal terminals 211 (TMDS Data2+−, differential signal terminals), a first signal terminal 211 (TMDS Data1 Shield), a second pair of first signal terminals 211 (TMDS Data0+−, differential signal terminals), a first signal terminal 211 (TMDS Clock Shield), a reserved terminal (Consumer Electronics Control, CEC), a communication terminal (Serial Clock, SCL), a ground terminal 213 (DDC/CEC Ground/HEAC Shield) and a detection terminal (Hot Plug Detect/HEAC−). In this embodiment, ten first receptacle terminals 21 are provided. The first signal terminals 211 comprise a plurality of first high-speed signal terminals 2111. In this embodiment, the first signal terminals 211 comprise a plurality of first high-speed signal terminals 2111, and the first pair of first signal terminals 211 (TMDS Data2+−, differential signal terminals) as well as the second pair of first signal terminals 211 (TMDS Data0+−, differential signal terminals) may be the first high-speed signal terminals 2111 for high speed signal transmission.

Please refer to FIGS. 1 to 4. In the first embodiment, the first receptacle terminals 21 are held in the base portion 11 and the tongue portion 12. Each of the first receptacle terminals 21 comprises a flat contact portion 214, a body portion 215, and a tail portion 216. The body portions 215 are held in the base portion 11 and the tongue portion 12. Each of the flat contact portions 214 is extending forward from the corresponding body portion 215 in the rear-to-front direction and on the first surface 12*a*, and each of the tail portions 216 is extending backward from the corresponding body portion 215 in the front-to-rear direction and extending out of the base portion 11. The first signal terminals 211 are on the first surface 12*a*, and the tail portions 216 are extending out of the bottom surface of the base portion 11. Further, the tail portions 216 are first bent and extending and then bent horizontally to be horizontal terminals.

Please refer to FIGS. 1 to 4. In the first embodiment, the second receptacle terminals 22 are at the base portion 11 and the tongue portion 12. In this embodiment, the second receptacle terminals 22 comprise a plurality of second signal terminal 221 and at least one power terminal 222, and the second receptacle terminals 22 are held in the base portion 11 and the tongue portion 12 and disposed at the second surface 12*b*. From a front view of the second receptacle terminals 22, the second receptacle terminals 22 comprise, from the right to left, a second signal terminal 221 (TMSD Data2 Shield), a first pair of second signal terminals 221 (TMDS Data1+−, differential signal terminals), a second signal terminal 221 (TMDS Data0 Shield), a second pair of second signal terminals 221 (TMDS Clock+−, differential signal terminals), a functional terminal (Utility/HEAC+), a communication terminal (Serial Data, SDA), and a power terminal 222 (+5V Power). In this embodiment, nine second receptacle terminals 22 are provided. The second signal terminals 221 comprise a plurality of second high-speed signal terminals 2211. In this embodiment, the first pair of second signal terminals 221 (TMDS Data1+−, differential signal terminals) may be the second high-speed signal terminals 2211 for high speed signal transmission.

Please refer to FIGS. 1 to 4. In the first embodiment, the second receptacle terminals 22 are held in the base portion 11 and the tongue portion 12. Each of the second receptacle terminals 22 comprises a flat contact portion 224, a body portion 225, and a tail portion 226. The body portions 225 are held in the base portion 11 and the tongue portion 12. Each of the flat contact portions 224 is extending forward from the corresponding body portion 225 in the rear-to-front direction and on the second surface 12*b*, and each of the tail portions 226 is extending backward from the corresponding body portion 225 in the front-to-rear direction and extending out of the base portion 11. The second signal terminals 221 are on the first surface 12*b*, the first signal terminals 221 and the second signal terminals are for transmitting HDMI signals, and the tail portions 226 are extending out of the bottom surface of the base portion 11. Further, the tail portions 226 are first bent and extending and then bent horizontally to be horizontal terminals.

Please refer to FIGS. 1 to 4, in the first embodiment, from the pin assignment of the first and second receptacle terminals 21, 22, it is understood that, the first receptacle terminals 21 and the second receptacle terminals 22 are respectively on the first surface 12*a* and the second surface 12*b* of the tongue portion 12. From a front view of the first receptacle terminals 21 and the second receptacle terminals 22, the positions of the flat contact portions 214 of the first receptacle terminals 21 are aligned by an offset with respect to the positions of the flat contact portions 224 of the second receptacle terminals 22. Therefore, when the flat contact portions 214, 224 transmit signals, the crosstalk interference between the receptacle terminals 21, 22 can be improved efficiently because of the pin assignment of the receptacle terminals 21, 22.

Please refer to FIGS. 1 to 4. In the first embodiment, the metallic shell 3 is a hollowed shell. The metallic shell 3 comprises a receptacle cavity 31 for receiving the insulated housing 1. The metallic shell 3 comprises an insertion opening 32 communicating with the receptacle cavity 31, a plurality of pins 33 at two sides of the metallic shell 3 and extending outwardly, and an external protruding structure 35.

Figure 6:
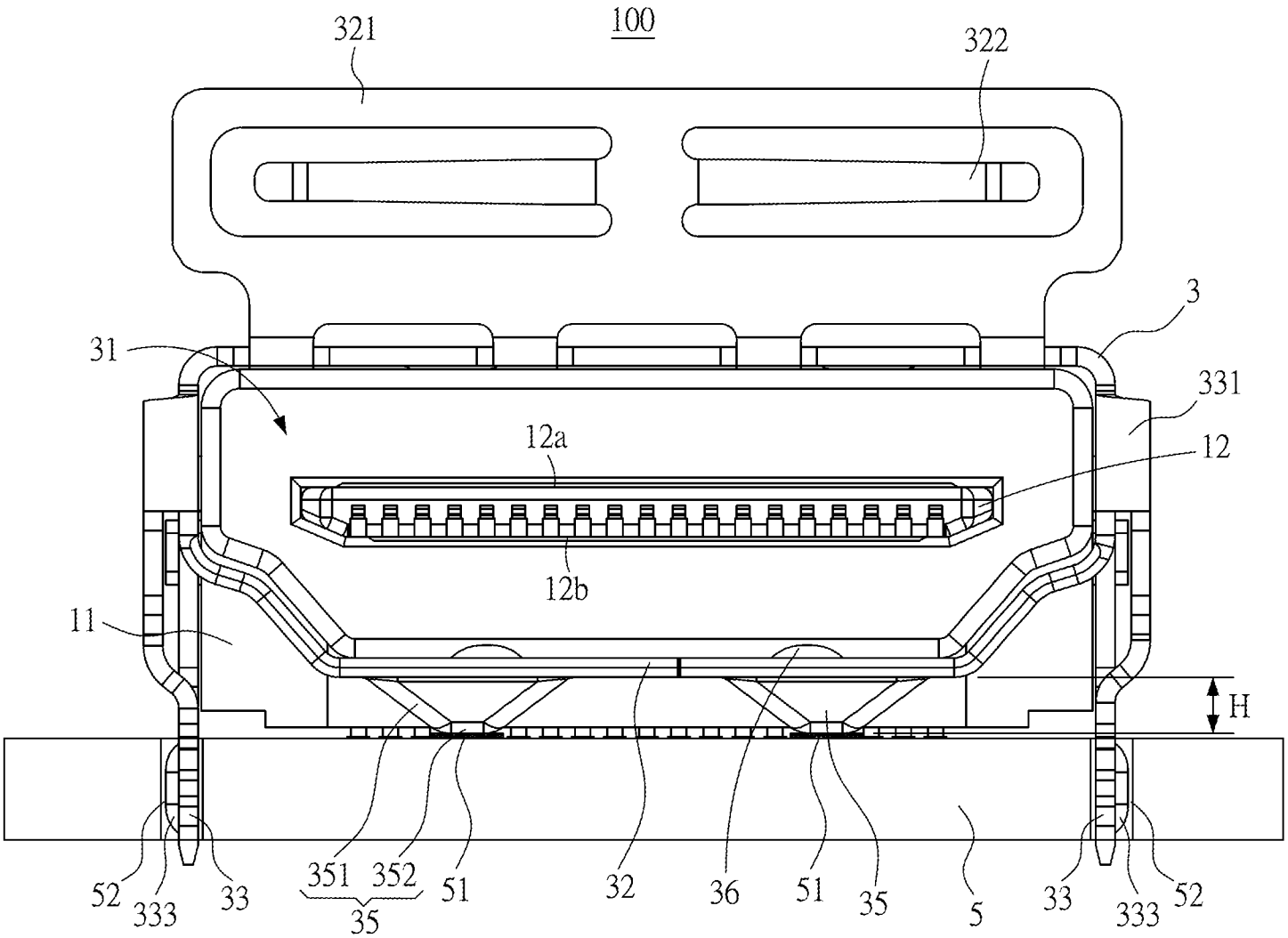
FIG. 6 illustrates a front view of the electrical receptacle connector and the circuit board of the exemplary embodiment.

Please refer to FIGS. 1, 3, and 6. In this embodiment, an upper portion and a lower portion of the insertion opening 32 is unsymmetrical with each other, and the width of the upper portion of the insertion opening 32 is greater than the width of the lower portion of the insertion opening 32, for meeting the specification of the HDMI connection interface. Alternatively, please refer to FIGS. 8 and 9. In the second embodiment, the upper portion and the lower portion of the insertion opening 32 is symmetrical with each other, and the width of the upper portion of the insertion opening 32 is equal to the width of the lower portion of the insertion opening 32, for meeting the specification of the USB type-C connection interface.

Please refer to FIG. 2. In this embodiment, the metallic shell 3 is a hollowed shell formed by bending a board. A slit 34 is formed on the bottom of the metallic shell 3. In this embodiment, the slit 34 is a cocktail-shaped slit, that is, two connected ends of the board have matched protrusions and recesses, and the protrusions and the recesses are mated with each other to form the slit 34. The slit 34 is formed at the central portion of the bottom of the metallic shell 3. The seamless (closed mated) configuration of the metallic shell 3 improves the structural strength of the metallic shell 3. Further, the seamless configuration of the metallic shell 3 also improves the resistance to electromagnetic interference (EMI). Moreover, a top surface 3*a* and a bottom surface 3*b* of the metallic shell 3 can be seamless, and without through holes.

In the foregoing embodiment, the metallic shell 3 has the slit 34 in cocktail-shaped, but embodiments are not limited thereto. In some embodiments, the metallic shell 3 may be a seamless hollowed shell formed by using drawing techniques. Such metallic shell 3 does not have any crack which may lessen the shielding performance of the metallic shell 3. Hence, the metallic shell 3 provides proper reductions to the electromagnetic interference (EMI) as well as Radio frequency interference (RFI). Furthermore, the seamless configuration of the metallic shell 3 allows the metallic shell 3 to have a beautiful appearance. In addition, the seamless configuration of the metallic shell 3 also improves the structural strength of the metallic shell 3.

Please refer to FIGS. 1 to 4. In the first embodiment, the metallic shell 3 comprises a plurality of internal protruding structures 36. The internal protruding structures 36 are rounded bumps formed by stamping techniques. The internal protruding structures 36 are respectively formed on the top surface 3*a* and the bottom surface 3*b* of the metallic shell 3, and the internal protruding structures 36 are extending toward the receptacle cavity 36. When a mating electrical plug connector is inserted into the receptacle cavity 31, the shell of the electrical plug connector is in contact with the internal protruding structures 36.

Please refer to FIGS. 1 to 4. In the first embodiment, an enclosed structure is formed at each of the internal protruding structures 36 of the metallic shell 3. The enclosed structure is devoid of any crack which may lessen the shielding performance of the metallic shell 3. Hence, the enclosed structures provide proper reductions to the electromagnetic interference (EMI) as well as Radio frequency interference (RFI). In addition, the seamless configuration of the enclosed structures also improves the structural strength of the metallic shell 3.

Please refer to FIGS. 1 to 4. In the first embodiment, the metallic shell 3 comprises a plurality of external protruding structures 35. The external protruding structures 35 are on the bottom surface 3*b* of the metallic shell 3 and aligned with each other. The external protruding structures 35 are between the pins 33. Each of the external protruding structures 35 comprises a contact end 352 extending outwardly from the bottom of the metallic shell 3. It is understood that, in this embodiment, the number of the external protruding structures 35 are plural, but embodiments are not limited thereto. In some embodiments, one external protruding structure 35 is on the bottom surface 3*b* of the metallic shell 3.

Please refer to FIGS. 1 to 4. In the first embodiment, the external protruding structure 35 comprises a cone-shaped extending portion 351 outwardly extending from the bottom surface 3*b* of the metallic shell 3 (as shown, the cone-shaped extending portion 351 has a V-shape profile), and the contact end 352 is formed at an end portion of the cone-shaped extending portion 351.

Please refer to FIGS. 1 to 4. In the first embodiment, the external protruding structure 35 forms a rectangular recess on the bottom of the metallic shell 3, and the cone-shaped extending portion 351 is extending outwardly from edges of the rectangular recess. Four edges of the rectangular recess are extending downwardly and inclinedly toward the center of the rectangular recess to form the cone-shaped extending portion 351. The width of the rectangular recess is large while the width of the contact end 352 is mall. Hence, manufacturers can make the cone-shaped extending portion 351 by applying stamping techniques on the rectangular recess of the metallic shell 3 in a convenient manner.

Please refer to FIGS. 1 to 4. In the first embodiment, an enclosed structure is formed at the external protruding structure 35 of the metallic shell 3. The enclosed structure is devoid of any crack which may lessen the shielding performance of the metallic shell 3. Hence, the enclosed structures provide proper reductions to the electromagnetic interference (EMI) as well as Radio frequency interference (RFI). In addition, the seamless configuration of the enclosed structures also improves the structural strength of the metallic shell 3.

Figure 5:
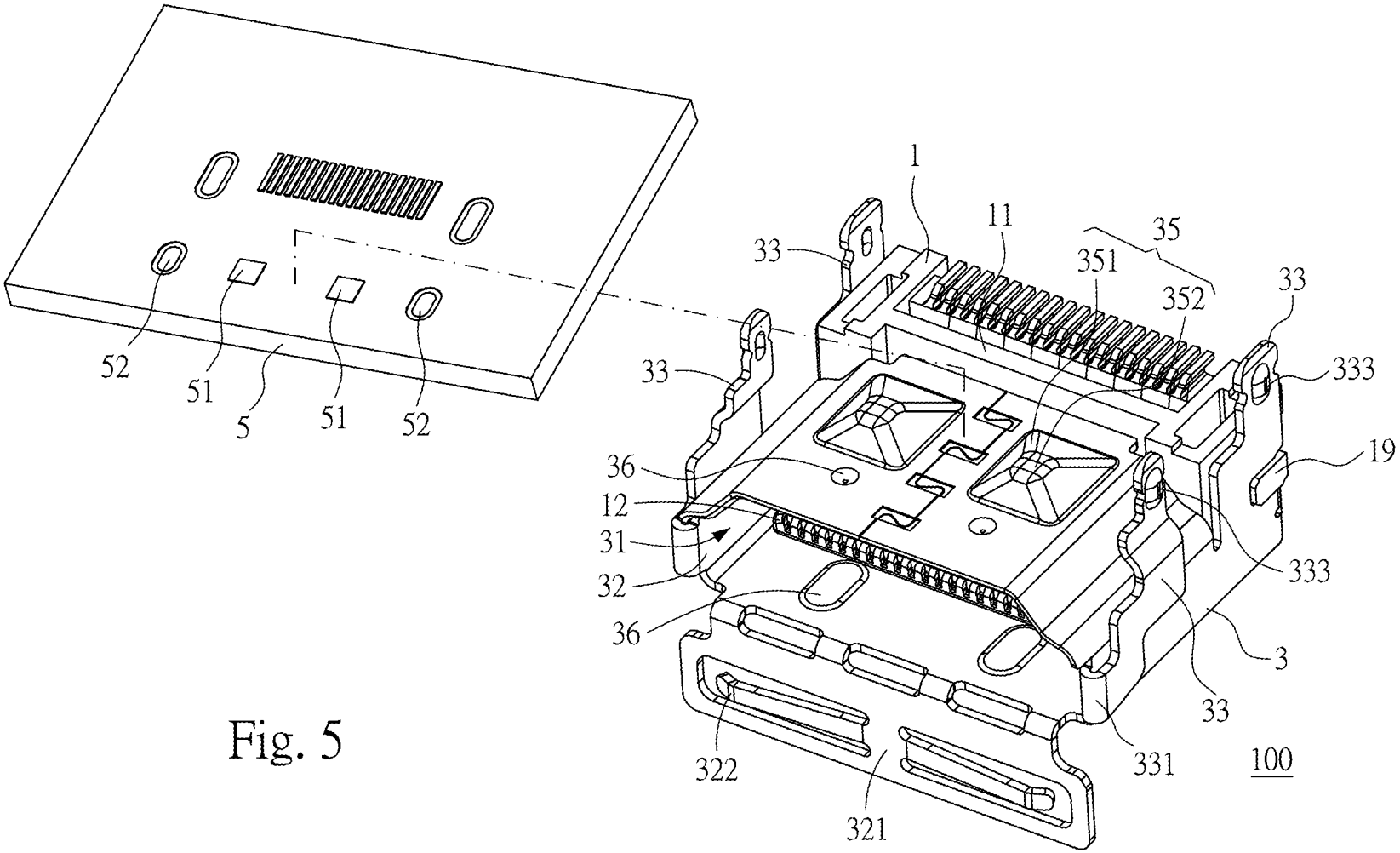
FIG. 5 illustrates an exploded view of the electrical receptacle connector and a circuit board of an exemplary embodiment of the instant disclosure.

Please refer to FIGS. 3 to 6. FIG. 5 illustrates an exploded view of the electrical receptacle connector 100 and a circuit board 5 of an exemplary embodiment of the instant disclosure. FIG. 6 illustrates a front view of the electrical receptacle connector 100 and the circuit board 5 of the exemplary embodiment. In the first embodiment, a predefined height H is formed between the bottom surface 3*b* of the metallic shell 3 and the surface of the circuit board 5. The cone structure formed by the external protruding structure 35 allows the predefined height H can be controlled and adjusted in an easier manner, so that the contact end 352 can be in contact with the contact points 51 on the circuit board 5. When the cone structure is replaced by rounded bumps, the rounded bumps may be not able to contact the contact points 51 of the circuit board 5 properly with the predefined height H between the metallic shell 3 and the circuit board 5.

Please refer to FIGS. 5 and 6. In the first embodiment, the contact end 352 of the external protruding structure 35 is in contact with the contact points 51 of the circuit board 5 in a point-contact manner, but embodiments are not limited thereto. In some embodiments, the contact end 352 of the external protruding structure 35 is a rectangular shape, and the contact point 51 on the circuit board 5 is also of a rectangular shape. Hence, the contact end 352 may be in contact with the contact point 51 of the circuit board 5 in a line-contact manner.

Please refer to FIGS. 3 to 6. In the first embodiment, the metallic shell 3 comprises a plurality of pins 33 at two sides thereof and extending outwardly. The pins 33 near two sides of the insertion opening 32 comprise turning portions 331 respectively extending from two side portions of the insertion opening 32. The pin 33 and the turning portion 331 are integrally formed as a whole by bending. The pins 33 are extending downwardly to be vertical legs. The pins 33 are respectively at two sides of the metallic shell 3. Hence, the metallic shell 3 is devoid of any crack which may lessen the shielding performance of the metallic shell 3. Therefore, the seamless configuration of the metallic shell 3 provides proper reductions to the electromagnetic interference (EMI) as well as Radio frequency interference (RFI). Furthermore, the seamless configuration of the metallic shell 3 allows the metallic shell 3 to have a beautiful appearance. In addition, the seamless configuration of the metallic shell 3 also improves the structural strength of the metallic shell 3.

Please refer to FIGS. 3 to 6. In this embodiment, the electrical receptacle connector 100 is provided for assembling on a circuit board 5. The circuit board 5 comprises a plurality of contact points 51 contacting the contact ends 352 and a plurality of holes 52 for being inserted by the pins 33. When the electrical receptacle connector 100 is to be assembled on the circuit board 5, the pins 33 are aligned for inserting into the holes 52 of the circuit board 5. Solders are provided in the holes 52. Therefore, when the pins 33 are inserted into the holes 33, the contacts between the pins 33 and the holes 52 allow the conduction and grounding of the connector. Further, the contacts between the contact points 51 and the contact ends 352 also facilitate the conduction and grounding.

Figure 7:
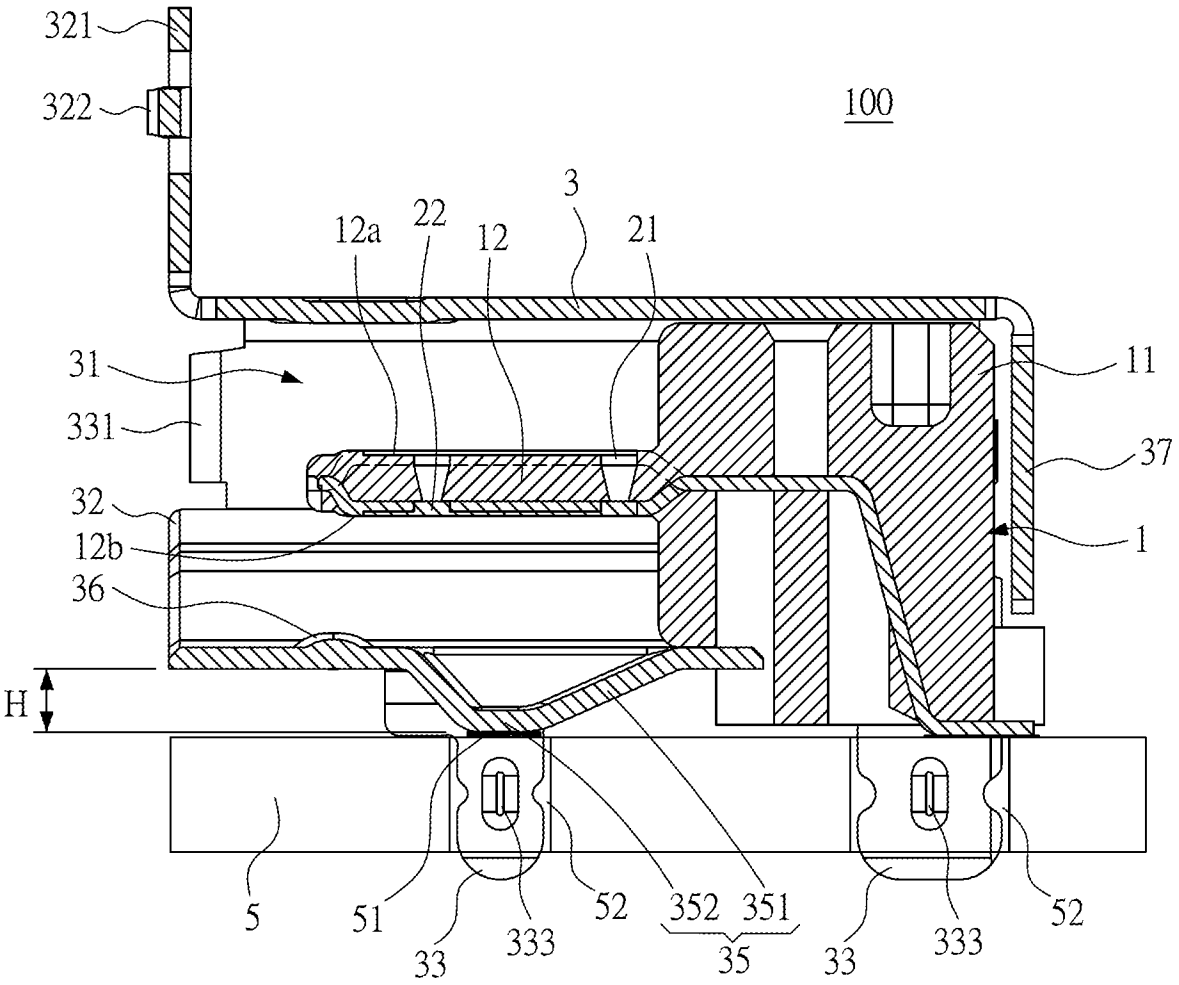
FIG. 7 illustrates a lateral view of the electrical receptacle connector and the circuit board of the exemplary embodiment.

Please refer to FIGS. 3 to 7. FIG. 7 illustrates a lateral view of the electrical receptacle connector 100 and the circuit board 5 of the exemplary embodiment. A protruding block 333 is outwardly protruding from an outer surface of each of the pins 33 for being received in the corresponding hole 52 of the circuit board 5. Therefore, when the size of the hole 52 of the circuit board 5 varies between 0.3 to 0.5 mm, the pin 33 along with the protruding block 333 can be received in the corresponding hole 52 of the circuit board 5, so that the pin 33 and the protruding block 333 are closely mated in the hole 52 and soldered with solders, thereby achieving the conduction and grounding of the electrical receptacle connector 100.

Please refer to FIGS. 2, 4, and 7. In the first embodiment, a rear portion of the metallic shell 3 further comprises a rear cover 37 covering a rear portion of the base portion 11. The rear cover 37 is outwardly extending from a top portion of the rear portion of the metallic shell 3, and the rear cover 37 is bent to cover the rear portion of the base portion 11. Since the rear portion of the insulated housing 1 is covered by the rear cover 37, electromagnetic waves can be shielded by the rear cover 37, thereby efficiently reducing the electromagnetic interference (EMI) and the radio frequency interference (RFI).

Please refer to FIGS. 2 and 4. In the first embodiment, a rear portion of the metallic shell 3 further comprises a buckling piece 38. In this embodiment, a plurality of buckling pieces 38 are extending from the rear portion of two side surfaces 3*s* of the metallic shell 3 and bending toward the receptacle cavity 31. In addition, buckling grooves 18 are on the rear portion of the base portion 11 for buckling with the buckling pieces 38. When the insulated housing 1 is assembled in the metallic shell 3, the buckling pieces 38 are bent and buckled with the buckling groove 18, so that the insulated housing 1 can be firmly assembled with the metallic shell 3.

Please refer to FIGS. 2 and 4. In the first embodiment, the metallic shell 3 further comprises a plurality of engaging grooves 39 on the pins 33. The engaging grooves 39 are formed on the pins 33 at two sides of the rear portion of the metallic shell 3. A plurality of engaging blocks 19 is on two sides of the base portion 11 for engaging with the engaging grooves 39. Therefore, the insulated housing 1 can be firmly assembled with the metallic shell 3.

Please refer to FIGS. 1 and 4. In the first embodiment, the metallic shell 3 comprises a bent member 321 extending outwardly from a top portion of the insertion opening 32. The bent member 321 is integrally formed with the metallic shell 3, and the bent member 321 is perpendicular to the top surface 3*a* of the metallic shell 3. The bent member 321 comprises a plurality of contact arms 322. The contact arms 322 are manufactured by applying stamping techniques on the bent member 321. The contact arms 322 are flexible arms; one of two ends of the contact arm 322 is extending out of the bent member 321 and is deflectable, and the other end of the contact arm 322 is fixed on the bent member 321. When the electrical receptacle connector 100 is assembled in the housing of the electronic device (e.g., mobile device and notebook), the arc-shaped free end of the contact arm 322 can be in contact with the housing of the electronic device in a convenient manner for grounding and conduction, thereby improving the electromagnetic compatibility (EMC).

Figure 9:
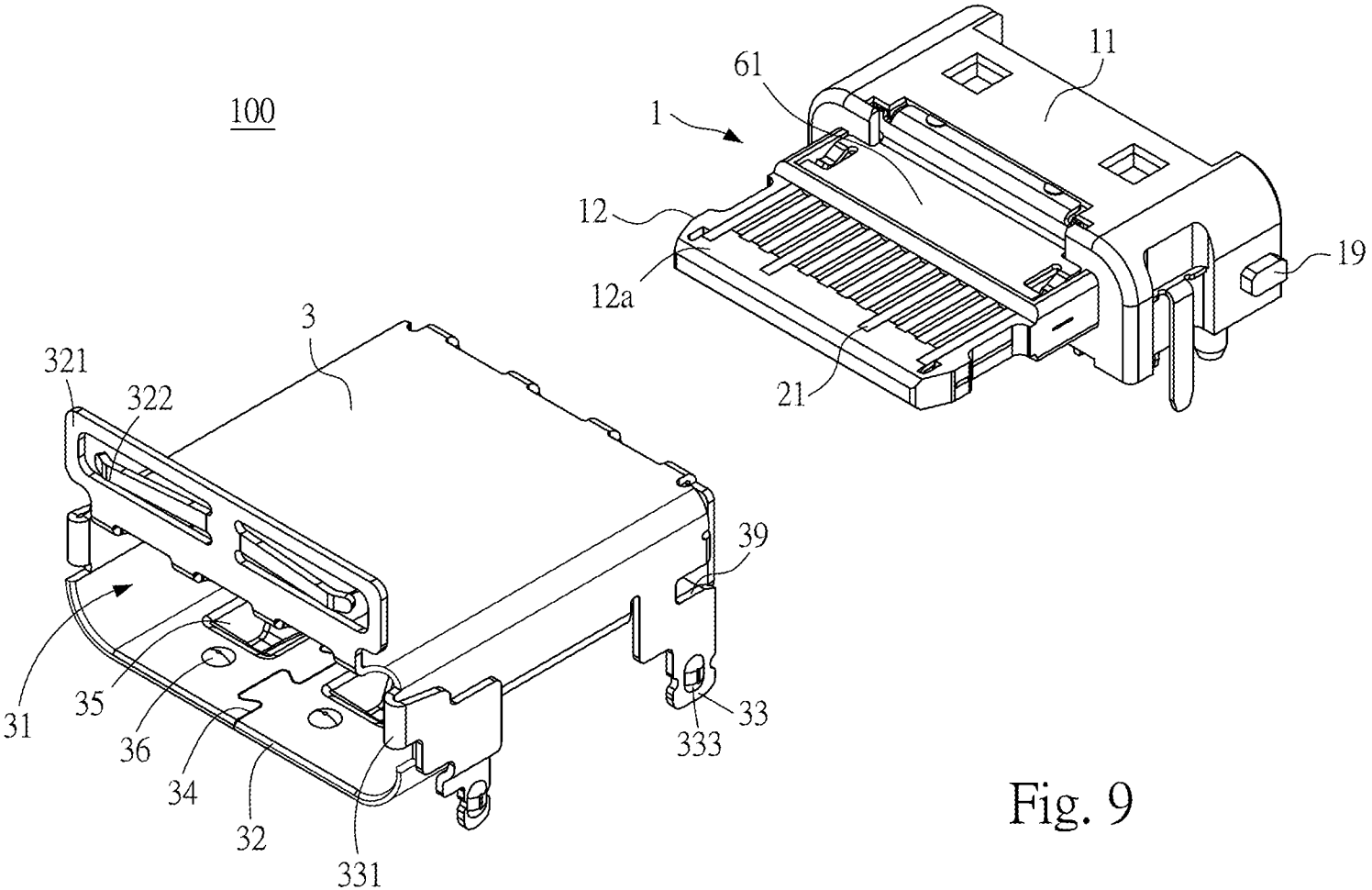
FIG. 9 illustrates an exploded view (2) of the electrical receptacle connector of the second embodiment.

Please refer to FIGS. 8 to 10, illustrating an electrical receptacle connector 100 of a second embodiment of the instant disclosure. FIG. 8 illustrates an exploded view (1) of the electrical receptacle connector 100 of the second embodiment of the instant disclosure. FIG. 9 illustrates an exploded view (2) of the electrical receptacle connector 100 of the second embodiment. FIG. 10 illustrates a schematic configuration diagram of the receptacle terminals of the electrical receptacle connector 100 of the second embodiment. In the second embodiment, the electrical receptacle connector 100 is in accordance with the specification of a USB type-C connection interface. In this embodiment, an upper portion and a lower portion of the insertion opening 32 of the electrical receptacle connector 100 are symmetrical with each other. That is, the electrical receptacle connector 100 can provide a reversible or dual orientation USB Type-C connector interface and pin assignments, i.e., a USB Type-C receptacle connector.

Please refer to FIGS. 8 to 10. In the second embodiment, the electrical receptacle connector 1 further comprises a first conductive sheet 61 and a second conductive sheet 62 arranged symmetrically with each other. From a front view of the first conductive sheet 61 (or the second conductive sheet 62), the conductive sheet has a reversed U-shaped appearance, and the structure of the first conductive sheet 61 is the same as the structure of the second conductive sheet 62. The first conductive sheet 61 and the second conductive sheet 62 are respectively on a first insulated member and a second insulated member of the insulated housing 1. The first conductive sheet 61 has two first contact legs at two sides thereof. The two first contact legs pass through two first through holes of the first insulated member and are in contact with two ground terminals 213 which are at two sides of the first receptacle terminals 21, respectively. Conversely the second conductive sheet 62 has two second contact legs at two sides thereof. The two second contact legs passes through two second through holes of the second insulated member and are in contact with two ground terminals 223 which are at two sides of the second receptacle terminals 22. Accordingly, the first conductive sheet 61 is in contact with the ground terminals 213 of the first receptacle terminals 21 and the second conductive sheet 62 is in contact with the ground terminals 223 of the second receptacle terminals 22 for grounding. Further, the first conductive sheet 61 and the second conductive sheet 62 are respectively in contact with the metallic shell 3. Therefore, when a mating electrical plug connector is mated with the electrical receptacle connector 100, a front end of the metallic shell of the electrical plug connector is in contact with the first conductive sheet 61 and the second conductive sheet 62, so that the metallic shell of the electrical plug connector is connected to the metallic shell 3 of the electrical receptacle connector 100. Hence, the conduction between the electrical plug connector and the electrical receptacle connector can be efficiently achieved through the first conductive sheet 61 and the second conductive sheet 62 with improved grounding and reduced electromagnetic interference (EMI).

Please refer to FIGS. 8 to 10. In the second embodiment, the first receptacle terminals 21 comprise a plurality of first signal terminals 211, at least one power terminal 212, and at least one ground terminal 213. The first signal terminals 211 comprises a plurality of pairs of first high-speed signal terminals 2111/2113 and a pair of first low-speed signal terminals 2112. From a front view of the first receptacle terminals 21, the first receptacle terminals 21 comprise, from left to right, a ground terminal 213 (Gnd), a first pair of first high-speed signal terminals 2111 (TX1+−, differential signal terminals for high-speed signal transmission), a power terminal 212 (Power/VBUS), a first function detection terminal (CC1, a terminal for inserting orientation detection of the connector and for cable recognition), a pair of first low-speed signal terminals 2112 (D+−, differential signal terminals for low-speed signal transmission), a first supplement terminal (SBU1, a terminal can be reserved for other purposes), another power terminal 312 (Power/VBUS), a second pair of first high-speed signal terminals 113 (RX2+−, differential signal terminals for high-speed signal transmission), and another ground terminal 213 (Gnd). In this embodiment, twelve first receptacle terminals 21 are provided for transmitting USB 3.0 signals. Each pair of the first high-speed signal terminals 2111/2113 is between the corresponding power terminal 212 and the adjacent ground terminal 213. The pair of the first low-speed signal terminals 2112 is between the first function detection terminal and the first supplement terminal.

In some embodiments, the rightmost ground terminal 213 (Gnd) (or the leftmost ground terminal 213 (Gnd)) or the first supplement terminal (SBU1) can be further omitted. Therefore, the total number of the first receptacle terminals 21 can be reduced from twelve terminals to seven terminals. Furthermore, the ground terminal 213 (Gnd) may be replaced by a power terminal 212 (Power/VBUS) and provided for power transmission. In this embodiment, the width of the power terminal 212 (Power/VBUS) may be, but not limited to, equal to the width of the first signal terminal 211. In some embodiments, the width of the power terminal 212 (Power/VBUS) may be greater than the width of the first signal terminal 211 and an electrical receptacle connector 100 having the power terminal 212 (Power/VBUS) can be provided for large current transmission.

Please refer to FIGS. 8 to 10. In the second embodiment, the first receptacle terminals 21 are held in the first insulated member of the insulated housing 1 and formed as the upper-row terminals of the electrical receptacle connector 100. Each of the first receptacle terminals 21 comprises a flat contact portion 214, a body portion 215, and a tail portion 216. For each of the first receptacle terminals 21, the body portion 215 is held in the first insulated member, the flat contact portion 214 is extending forward from the body portion 215 in the rear-to-front direction and partly exposed upon the first surface 12*a* of the tongue portion 12, and the tail portion 216 is extending backward from the body portion 215 in the front-to-rear direction and protruding from the rear portion of the first insulated member. The first signal terminals 211 are disposed on the first surface 12*a* and transmit first signals (namely USB 3.0 signals). The tail portions 216 are bent horizontally to form flat legs, named legs manufactured by SMT (surface mounted technology), which can be mounted or soldered on the surface of a printed circuit board by using surface mount technology. Alternatively; the tail portions 216 may be extending downwardly to form vertical legs, named legs manufactured by through-hole technology, which can be inserted into holes drilled in a printed circuit board (PCB). Moreover, the overall width of the tail portions 216 is equal to the overall width of the body portions 215; that is, each of the tail portions 216 and the corresponding body portion 215 are aligned on a same line, so that the distance between the tail portions 216 corresponds to the distance between the contact points 51 of the circuit board 5.

Please refer to FIGS. 8 to 10. In the second embodiment, the second receptacle terminals 22 comprise a plurality of second signal terminals 221, at least one power terminal 222, and at least one ground terminal 223. The second receptacle terminals 22 comprise a plurality of pairs of second high-speed signal terminals 2211/2213 and a pair of second low-speed signal terminals 2212. From a front view of the second receptacle terminals 22, the second receptacle terminals 22 comprise, from right to left, a ground terminal 223 (Gnd), a first pair of second high-speed signal terminals 2211 (TX2+−, differential signal terminals for high-speed signal transmission), a power terminal 222 (Power/VBUS), a second function detection terminal (CC2, a terminal for inserting orientation detection of the connector and for cable recognition), a pair of second low-speed signal terminals 2212 (D+−, differential signal terminals for low-speed signal transmission), a second supplement terminal (SBU2, a terminal can be reserved for other purposes), another power terminals 222 (Power/VBUS), a second pair of second high-speed signal terminals 2213 (RX1+−, differential signal terminals for high-speed signal transmission), and another ground terminal 223 (Gnd). In this embodiment, twelve second receptacle terminals 22 are provided for transmitting USB 3.0 signals. Each pair of the second high-speed signal terminals 2211/2213 is between the corresponding power terminal 222 and the adjacent ground terminal 223. The pair of the second low-speed signal terminals 2212 is between the second function detection terminal and the second supplement terminal.

In some embodiments, the rightmost ground terminal 223 (or the leftmost ground terminal 223) or the second supplement terminal (SBU2) can be further omitted. Therefore, the total number of the second receptacle terminals 22 can be reduced from twelve terminals to seven terminals. Furthermore, the rightmost ground terminal 223 may be replaced by a power terminal 222 and provided for power transmission. In this embodiment, the width of the power terminal 222 (Power/VBUS) may be, but not limited to, equal to the width of the second signal terminal 221. In some embodiments, the width of the power terminal 222 (Power/VBUS) may be greater than the width of the second signal terminal 221 and an electrical receptacle connector 100 having the power terminal 222 (Power/VBUS) can be provided for large current transmission.

Please refer to FIGS. 8 to 10. In the second embodiment, the second receptacle terminals 22 are held in the second insulated member of the insulated housing 1 and formed as the lower-row terminals of the electrical receptacle connector 100. In addition, the first receptacle terminals 21 are substantially aligned parallel with the second receptacle terminals 22. In this embodiment, each of the second receptacle terminals 22 comprises a flat contact portion 224, a body portion 225, and a tail portion 226. For each of the second receptacle terminals 22, the body portion 225 is held in the second insulated member and the tongue portion 12, the flat contact portion 224 is extending from the body portion 225 in the rear-to-front direction and partly exposed upon the second surface 12*b* of the tongue portion 12, and the tail portion 226 is extending backward from the body portion 225 in the front-to-rear direction and protruding from the rear portion of the second insulated member. The second signal terminals 221 are disposed at the second surface 12*b* and transmit second signals (i.e., USB 3.0 signals). The tail portions 226 are bent horizontally to form flat legs, named legs manufactured by SMT (surface mounted technology), which can be mounted or soldered on the surface of a printed circuit board by using surface mount technology. Alternatively, the tail portions 226 may be extending downwardly to form vertical legs, named legs manufactured by through-hole technology, which can be inserted into holes drilled in a printed circuit board (PCB). The tail portions 216 of the first receptacle terminals 21 and the tail portions 226 of the second receptacle terminals 22 are arranged in a staggered manner from the top view.

Please refer to FIGS. 8 to 10. In the second embodiment, the electrical receptacle connector 100 comprises a shielding plate 7 between the first receptacle terminals 21 and the second receptacle terminals 22. The shielding plate 7 comprises a plate body and a plurality of shielding legs. The plate body is between the flat contact portions 214 of the first receptacle terminals 21 and the flat contact portions 224 of the second receptacle terminals 22. That is, the plate body is integrally formed at the second insulated member and between the flat contact portions 214 of the first receptacle terminals 21 and the flat contact portions 224 of the second receptacle terminals 22. Specifically, in this embodiment, the plate body are lengthened and widened, so that the front end of the plate body is near the front lateral surface of the tongue portion 12. Two sides of the plate body protrude from two sides of the tongue portion 12 for being in contact with an electrical plug connector, and the rear end of the plate body is near the rear portion of the second insulated member. Accordingly, the plate body can be disposed on the tongue portion 12 and the second insulated member, and the structural strength of the tongue portion 12 and the shielding performance of the tongue portion 12 can be improved.

Please refer to FIGS. 8 to 10. In the second embodiment, the shielding legs are extending from the rear portion of the shielding plate 7 to form vertical legs. That is, the shielding legs are exposed from the second insulated member and in contact with a circuit board 5. In this embodiment, the crosstalk interference can be reduced by the shielding of the shielding plate 7 when the flat contact portions 214, 224 transmit signals. Furthermore, the structural strength of the tongue portion 12 can be improved by the assembly of the shielding plate 7. In addition, the shielding legs of the shielding plate 7 are exposed from the second insulated member and in contact with the circuit board 5 for conduction and grounding.

Please refer to FIGS. 8 to 10. In the second embodiment, the shielding plate 7 further comprises a plurality of hooks. The hooks are extending outward from two sides of the front portion of the plate body and protruding from the front lateral surface and two sides of the tongue portion 12. When an electrical plug connector is mated with the electrical receptacle connector 100, elastic pieces at two sides of an insulated housing of the electrical plug connector are engaged with the hooks, and the elastic pieces would not wear against the tongue portion 12 of the electrical receptacle connector 100. Hence, the shielding plate 7 can be in contact with the metallic shell 3 for conduction and grounding.

Please refer to FIGS. 8 to 10. In the second embodiment, the first receptacle terminals 21 and the second receptacle terminals 22 are disposed upon the upper surface 12*a* and the lower surface 12*b* of the tongue portion 12, respectively, and pin-assignments of the first receptacle terminals 21 and the second receptacle terminals 22 are point-symmetrical with a central point of the receptacle cavity 31 of the metallic shell 3 as the symmetrical center. In other words, pin-assignments of the first receptacle terminals 21 and the second receptacle terminals 22 have 180-degree symmetrical design with respect to the central point of the receptacle cavity 31 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 21 (or the second receptacle terminals 22), are rotated by 180 degrees with the symmetrical center as the rotating center, the first receptacle terminals 21 and the second receptacle terminals 22 are overlapped. That is, the rotated first receptacle terminals 21 are arranged at the position of the original second receptacle terminals 22, and the rotated second receptacle terminals 22 are arranged at the position of the original first receptacle terminals 21. In other words, the first receptacle terminals 21 and the second receptacle terminals 22 are arranged upside down, and the pin assignments of the first receptacle terminals 21 are left-right reversal with respect to that of the second receptacle terminals 22. An electrical plug connector is inserted into the electrical receptacle connector 100 with a first orientation where the upper surface 12*a* of the tongue portion 12 is facing up, for transmitting first signals. Conversely, the electrical plug connector is inserted into the electrical receptacle connector 100 with a second orientation where the upper surface 12*a* of the tongue portion 12 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

In the foregoing embodiments, the receptacle terminals 21, 22 are provided for transmitting USB 3.0 signals, but embodiments are not limited thereto. In some embodiments, for the first receptacle terminals 21 in accordance with transmission of USB 2.0 signals, the first pair of the first high-speed signal terminals 2111 (TX1+−) and the second pair of the first high-speed signal terminals 2113 (RX2+−) are omitted, and the pair of the first low-speed signal terminals 2112 (D+−) and the power terminals 212 (Power/VBUS) are retained. While for the second receptacle terminals 22 in accordance with transmission of USB 2.0 signals, the first pair of the second high-speed signal terminals 2211 (TX2+−) and the second pair of the second high-speed signal terminals 2213 (RX1+−) are omitted, and the pair of the second low-speed signal terminals 2212 (D+−) and the power terminals 222 (Power/VBUS) are retained.

As above, according to some embodiments of the instant disclosure, both the pins provided on the metallic shell as well as the external protruding structure allow the metallic shell to have a non-crack configuration (seamless configuration). Therefore, the non-crack configuration of the metallic shell improves the reduction to the electromagnetic interference. Further, the internal protruding structure is also devoid of any crack. Hence, the metallic shell provides proper reductions to the electromagnetic interference (EMI) as well as Radio frequency interference (RFI). Furthermore, the seamless configuration of the metallic shell allows the metallic shell to have a beautiful appearance. In addition, the seamless configuration of the metallic shell also improves the structural strength of the metallic shell.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector comprising:

an insulated housing comprising a base portion and a tongue portion extending from the base portion, wherein the tongue portion has a first surface and a second surface;

a plurality of first receptacle terminals, wherein each of the first receptacle terminals is held in the base portion and the tongue portion and disposed at the first surface;

a plurality of second receptacle terminals, wherein each of the second receptacle terminals is held in the base portion and the tongue portion and disposed at the second surface; and a metallic shell comprising a receptacle cavity for receiving the insulated housing, an insertion opening being in communication with the receptacle cavity, a plurality of pins at two sides of the metallic shell and extending outwardly, an external protruding structure being on a bottom surface of the metallic shell and between the pins, a buckling piece being extending from the rear portion of a side surface of the metallic shell and bent toward the receptacle cavity, and a buckling groove on a rear portion of the base portion for buckling with the buckling piece, wherein the external protruding structure comprises a contact end extending outwardly from the metallic shell, and an enclosed structure is formed at the external protruding structure of the metallic shell, and wherein there is no through holes forms on a top surface and the bottom surface of the metallic shell.

2. The electrical receptacle connector according to claim 1, wherein the metallic shell comprises a plurality of external protruding structures on the bottom surface of the metallic shell.

3. The electrical receptacle connector according to claim 2, wherein the external protruding structure comprises a cone-shaped extending portion outwardly extending from the bottom surface of the metallic shell, and the contact end is formed at an end portion of the cone-shaped extending portion.

4. The electrical receptacle connector according to claim 1, wherein the external protruding structure comprises a cone-shaped extending portion outwardly extending from the bottom surface of the metallic shell, and the contact end is formed at an end portion of the cone-shaped extending portion.

5. The electrical receptacle connector according to claim 1, wherein the metallic shell comprises a plurality of internal protruding structures, the internal protruding structures are respectively formed on a top surface and the bottom surface of the metallic shell, the internal protruding structures are extending toward the receptacle cavity, and an enclosed structure is formed at each of the internal protruding structures of the metallic shell.

6. The electrical receptacle connector according to claim 1, wherein an upper portion and a lower portion of the insertion opening are symmetrical or unsymmetrical with each other.

7. The electrical receptacle connector according to claim 1, wherein the pins comprise turning portions respectively extending from two side portions of the insertion opening.

8. The electrical receptacle connector according to claim 1, further comprising a circuit board, wherein the circuit board comprises a plurality of contact points contacting the contact end and a plurality of holes for being inserted by the pins.

9. The electrical receptacle connector according to claim 8, wherein a protruding block is outwardly protruding from an outer surface of each of the pins for being received in the corresponding hole.

10. The electrical receptacle connector according to claim 1, wherein a rear portion of the metallic shell further comprises a rear cover covering a rear portion of the base portion.

11. The electrical receptacle connector according to claim 1, wherein the metallic shell further comprises a plurality of engaging grooves on the pins; a plurality of engaging blocks is on two sides of the base portion for engaging with the engaging grooves.

12. The electrical receptacle connector according to claim 1, wherein the first receptacle terminals further comprise at least one first power terminal and at least one first ground terminal, the second receptacle terminals further comprise at least one second power terminal and at least one second ground terminal.

13. The electrical receptacle connector according to claim 1, wherein the metallic shell comprises a bent member extending outwardly from a top portion of the insertion opening, wherein the bent member comprises a plurality of contact arms.

14. The electrical receptacle connector according to claim 1, wherein the first receptacle terminals comprise a plurality of first signal terminals, and the first signal terminals comprise a plurality of first high-speed signal terminals.

15. The electrical receptacle connector according to claim 1, wherein the second receptacle terminals comprise a plurality of second signal terminals and the second signal terminals comprise a plurality of second high-speed signal terminals.

* * * * *